US012490764B2

(12) United States Patent
Nupp et al.

(10) Patent No.: US 12,490,764 B2
(45) Date of Patent: Dec. 9, 2025

(54) STORAGE CONTAINERS, PRODUCTS, AND METHODS OF PACKING A SMOKABLE PRODUCT

(71) Applicant: Slap N Tickle Ltd., Holland, OH (US)

(72) Inventors: Brian Nupp, Maumee, OH (US); Michael Wiedle, Castalia, OH (US)

(73) Assignee: Slap N Tickle Ltd., Holland, OH (US)

( * ) Notice: Subject to any disclaimer, the term of this patent is extended or adjusted under 35 U.S.C. 154(b) by 229 days.

(21) Appl. No.: 18/121,662

(22) Filed: Mar. 15, 2023

(65) Prior Publication Data

US 2023/0210164 A1 Jul. 6, 2023

Related U.S. Application Data

(63) Continuation of application No. 16/924,314, filed on Jul. 9, 2020, now Pat. No. 11,606,968.
(Continued)

(51) Int. Cl.
*A24C 5/42* (2006.01)
*A24C 5/00* (2020.01)
(Continued)

(52) U.S. Cl.
CPC ..... *A24C 5/42* (2013.01); *A24C 5/002* (2013.01); *A24D 1/022* (2013.01); *A24F 17/00* (2013.01); *B65D 85/1018* (2013.01)

(58) Field of Classification Search
CPC ..... A24C 5/002; A24C 5/42; A24D 1/022; A24F 17/00; B65D 3/06; B65D 3/267
See application file for complete search history.

(56) References Cited

U.S. PATENT DOCUMENTS 4,033,358 A * 7/1977 Harrington ..... A25D 1/08 131/365
7,377,281 B2 5/2008 Bachmann
(Continued)

FOREIGN PATENT DOCUMENTS

WO 2012064735 A2 5/2012
WO 2016049648 A2 3/2016
(Continued)

OTHER PUBLICATIONS

Manifest Seven. Cone Artist, retrieved from internet Oct. 28, 2020, URL:<https://www.hippiebutler.com/product/cone-artist/>.
(Continued)

*Primary Examiner* — Michael H. Wilson
*Assistant Examiner* — Ronnie Kirby Jordan
(74) *Attorney, Agent, or Firm* — MacMillan, Sobanski & Todd, LLC

(57) ABSTRACT

Storage containers, products, and methods of packing a smoking product are described. An example storage container has a main body that has a first end, a second end, a lengthwise axis, a width, and defines a chamber and an indicium. The lengthwise axis has a midpoint. Each of the first end and second end is moveable from a sealed configuration to an unsealed configuration. The width of the main body tapers from the second end toward the first end. The indicium is defined at a location between the midpoint of the lengthwise axis and the first end and extends along a portion of the width of the main body. The main body has a first width at the location between the midpoint of the lengthwise axis and the first end and a second width at the second end. The first width is less than the second width.

13 Claims, 8 Drawing Sheets

Related U.S. Application Data

(60) Provisional application No. 62/872,271, filed on Jul. 10, 2019.

(51) Int. Cl.

| | |
|---|---|
| ***A24D 1/02*** | (2006.01) |
| ***A24F 17/00*** | (2006.01) |
| ***B65D 85/10*** | (2006.01) |

(56) References Cited

U.S. PATENT DOCUMENTS

| | | | | |
|---|---|---|---|---|
| 9,179,706 | B2 | 11/2015 | Jespersen et al. | |
| 9,282,767 | B1 | 3/2016 | Sinclair, Jr. | |
| 9,516,897 | B1 | 12/2016 | Sinclair, Jr. | |
| 9,655,381 | B2 | 5/2017 | Sinclair, Jr. | |
| 9,826,776 | B1 | 11/2017 | Sinclair, Jr. | |
| 10,080,385 | B2 | 9/2018 | Sinclair, Jr. | |
| 10,092,031 | B1 | 10/2018 | Sinclair, Jr. | |
| 10,111,460 | B2 | 10/2018 | Tully | |
| 2006/0037622 | A1* | 2/2006 | Bachmann | A24D 1/022 131/347 |
| 2013/0112216 | A1* | 5/2013 | Clarke | A24D 3/04 131/331 |
| 2014/0182605 | A1 | 7/2014 | Sinclair, Jr. et al. | |
| 2015/0083142 | A1 | 3/2015 | Sinclair, Jr. et al. | |
| 2016/0088871 | A1 | 3/2016 | Sinclair, Jr. et al. | |
| 2016/0270436 | A1 | 9/2016 | Sinclair, Jr. et al. | |
| 2017/0027222 | A1 | 2/2017 | Sinclair, Jr. | |
| 2018/0325165 | A1 | 11/2018 | Sinclair, Jr. | |

FOREIGN PATENT DOCUMENTS

| | | | |
|---|---|---|---|
| WO | 2016141377 | A1 | 9/2016 |
| WO | 2017015417 | A1 | 1/2017 |

OTHER PUBLICATIONS

BBK Tobacco & Foods, LLP D/B/A HBI International. RAW Cones, retrieved from Internet Oct. 28, 2020, URL:<https://rawthentic.com/cones/>, pp. 1-10.

BBK Tobacco & Foods, LLP D/B/A HBI International. RAWLING, retrieved from Internet Oct. 28, 2020, URL:<https://rawthentic.com/rawling/>, pp. 1-7.

Canadian Intellectual Property Office Examination Report, Application No. 3086246, dated Jun. 13, 2025.

* cited by examiner

STORAGE CONTAINERS, PRODUCTS, AND METHODS OF PACKING A SMOKABLE PRODUCT

FIELD

The disclosure relates generally to the field of smoking products. More particularly, the disclosure relates to storage containers, products, and methods of packing a smoking product.

BACKGROUND

Individuals that utilize smokable products sometimes prefer to customize the product by using personal smokable materials rather than purchasing pre-filled smokable products. When customizing the product prior to smoking, these individuals generally use a pre-formed sheet of material that must be filled with the smokable material before the smokable product can be utilized. Various pre-formed sheets of material have been marketed and packaged. However, each of these products has drawbacks. For example, these products fail to provide the individual with any structure for filling the pre-formed sheet of material. Furthermore, these products fail to provide the individual with a pre-formed sheet of material that includes any structure, such as a wire member, that assists the user in handling the product during use.

Therefore, a need exists for new and useful storage containers, products, and methods of packing a smoking product.

SUMMARY OF SELECTED EXAMPLE EMBODIMENTS

Various storage containers, products, and methods of packing a smoking product are described herein.

An example storage container has a main body. The main body has a first end, a second end, a length that extends from the first end to the second end, a lengthwise axis that extends from the first end to the second end, a width, and defines a chamber and an indicium. The lengthwise axis has a midpoint. The first end is moveable from a sealed configuration to an unsealed configuration. The second end is moveable from a sealed configuration to an unsealed configuration. The width of the main body tapers from the second end to the first end. The indicium is defined at a location between the midpoint of the lengthwise axis and the first end and extends along a portion of the width of the main body. The main body has a first width at the location between the midpoint of the lengthwise axis and the first end. The main body has a second width at the second end. The first width is less than the second width.

An example product comprises a storage container and a smokable product. The storage container has a first end, a second end, a length that extends from the first end to the second end, a lengthwise axis that extends from the first end to the second end, a width, and defines a chamber and an indicium. The lengthwise axis has a midpoint. The width of the storage container tapers along the length. The indicium is defined at a location between the midpoint of the lengthwise axis and the first end and extends along a portion of the width of the storage container. The storage container has a first width at the location between the midpoint of the lengthwise axis and the first end. The smokable product is disposed within the chamber and has a smokable product first end, a smokable product second end, a smokable product length that extends from the smokable product first end to the smokable product second end, and a smokable product width that tapers along the smoking product length. The smokable product first end has a smokable product first width. The smokable product second end has a smokable product second width that is greater than the smokable product first width. The first width of the storage container is less than the smokable product second width.

An example method of packing a smoking product includes: obtaining a product that has a storage container and a smokable product; separating a first portion of the storage container from a second portion of the storage container to define a first opening of the storage container providing access to a chamber of the storage container; removing the smokable product from the storage container; separating a third portion of the storage container from the second portion of the storage container to define a second opening of the storage container providing access to the chamber; inserting a third end of the storage container into a smokable product second end such that the storage container is partially disposed within a smokable product passageway; inserting a smokable material through the second opening of the storage container and into the chamber such that the smokable material enters the smokable product passageway; removing the storage container from the smokable product passageway.

Additional understanding of the example storage containers, products, and methods of packing a smoking product can be obtained by review of the detailed description, below, and the appended drawings.

DETAILED DESCRIPTION

The following detailed description and the appended drawings describe and illustrate various example embodiments of storage containers, products, and methods of packing a smoking product. The description and illustration of these examples are provided to enable one skilled in the art to make and use a storage container, make and use a product, and to practice a method of packing a smoking product. They are not intended to limit the scope of the claims in any manner.

Figure 1:
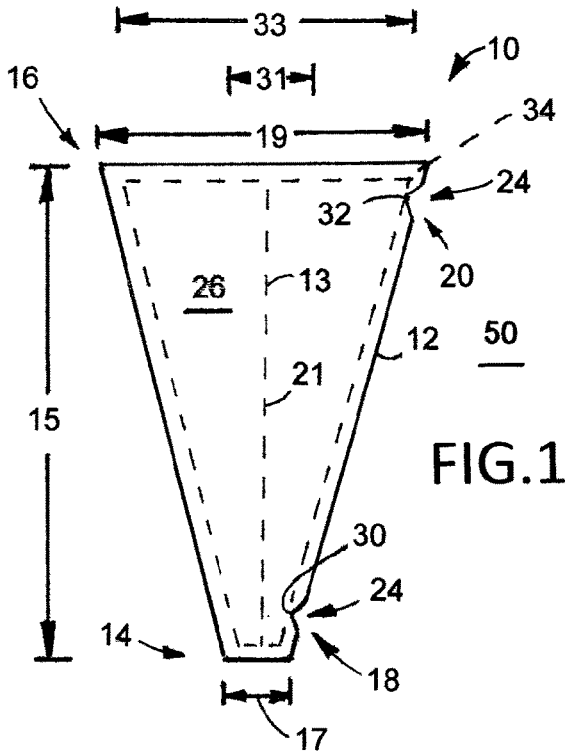
FIG. 1 is an elevation view of a first example storage container. Each of the first end and the second end is in a sealed configuration.
Figure 2:
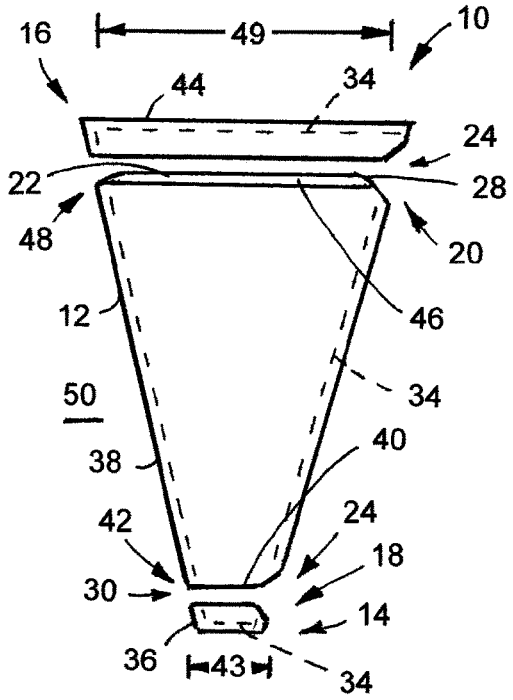
FIG. 2 is a perspective view of the storage container illustrated in FIG. 1. Each of the first end and the second end is in an unsealed configuration.
Figure 3:
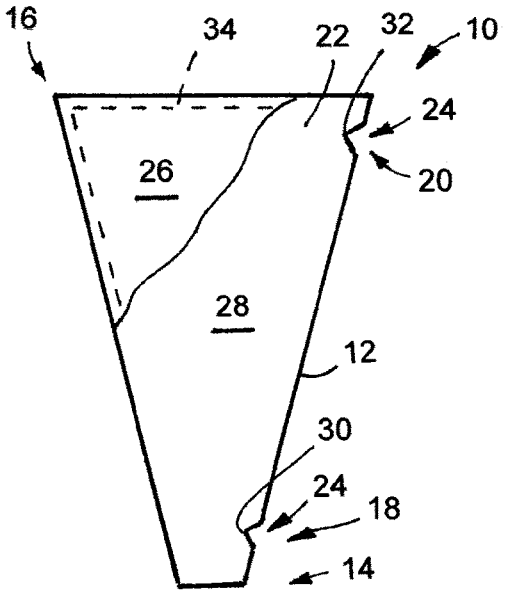
FIG. 3 is a partial elevation view of the storage container illustrated in FIG. 1.

FIGS. 1, 2, and 3 illustrate a first example storage container 10. The storage container 10 has a main body 12 that has a first end 14, a second end 16, a first indicium 18, a second indicium 20, a lengthwise axis 13, a length 15, a first width 17, a second width 19, and defines a chamber 22 and notches 24. In the illustrated embodiment, the main body 12 is formed of a first piece of material 26 attached to a second piece of material 28. The lengthwise axis 13 extends from the first end 14 to the second end 16 and has a midpoint 21. The length 15 extends from the first end 14 to the second end 16. The first width 17 is disposed at the first end 14 and the second width 19 is disposed at the second end 16. The first width 17 is less than the second width 19. The width of the main body 12 tapers from the second end 16 to the first end 14. However, alternative embodiments can include a main body that tapers along a portion of the length of the main body.

Each of the first indicium 18 and the second indicium 20 comprises a notch 24 that extends into the main body 12. The first indicium 18 is defined at a first location 30 disposed between the midpoint 21 of the lengthwise axis 13 and the first end 14 and extends along a portion of the width of the main body 12. The main body 12 has a third width 31 at the first location 30 between the midpoint 21 of the lengthwise axis 13 and the first end 14. The third width 31 is greater than the first width 17 and less than the second width 19. The second indicium 20 is defined at a second location 32 disposed between the midpoint 21 of the lengthwise axis 13 and the second end 16 and extends along a portion of the width of the main body 12. The main body 12 has a fourth width 33 at the second location 32 between the midpoint 21 of the lengthwise axis 13 and the second end 16. The fourth width 33 is greater than the third width 31 and the first width 17 and is less than the second width 19.

The first end 14 is moveable from a sealed configuration, as shown in FIG. 1, to an unsealed configuration, as shown in FIG. 2. The second end 16 is moveable from a sealed configuration, as shown in FIG. 1, to an unsealed configuration, as shown in FIG. 2. When attached to one another, the first piece of material 26 and the second piece of material 28 defines a sealed edge 34 that extends around the chamber 22 sealing the chamber 22 from an environment exterior 50 to the chamber 22, as shown in FIGS. 1 and 2. To unseal the storage container 10, a first portion 36 of the storage container 10 is separated from a second portion 38 of the storage container 10 to define a first opening 40 that provides access to the chamber 22 and a third end 42. Alternatively, or in combination with separating a first portion 36 from a second portion 38, to unseal the storage container 10, a third portion 44 of the storage container 10 is separated from the second portion 38 of the storage container 10 to define a second opening 46 that provides access to the chamber 22 and a fourth end 18. When in the unsealed configuration, the chamber 22 is in fluid communication with the environment exterior 50 to the chamber 22, as shown in FIG. 3. The first and third portions 36, 44 can be separated from the second portion 38 using any suitable technique or method, such as tearing the main body 12 at the notch 24 defined at the first location 30 and along a portion, or the entirety, of the third width 31 and/or tearing the main body 12 at the notch 24 defined at the second location 32 and along a portion, or the entirety, of the fourth width 33.

The third end 12 and the fourth end 48 can have any suitable width and/or circumference and selection of a suitable width or circumference can be based on various considerations, including the structural configuration of a main body. Examples of widths and/or circumferences considered suitable for a third end and/or fourth end of a main body include widths and/or circumferences equal to, less than, greater than, or about 10 centimeters, 9, centimeters, 8 centimeters, 7 centimeters, 6 centimeters, 5 centimeters, 4 centimeters, 3 centimeters, 2 centimeters, 1 centimeter, widths and/or circumferences between about 10 centimeters and about 2 centimeters, 12 millimeters, 11 millimeters, 10 millimeters, 9 millimeters, 8 millimeters, 7 millimeters, 6 millimeters, 5 millimeters, 4 millimeters, widths and/or circumferences between about 12 millimeters and about 4 millimeters, and any other width and/or circumference considered suitable for a particular embodiment. In the illustrated embodiment, the third end 12 has a fifth width 43 equal to about 8 millimeters and the fourth end 18 has a sixth width 19 equal to about 6 centimeters, as shown in FIG. 3.

Any suitable indicium can be included on a main body of a storage container and selection of a suitable indicium can be based on various considerations, including the material that forms the main body of a storage container. Examples of indicia considered suitable to include on a main body of a storage container include one, or a plurality of, perforations that extend through a portion, or the entirety, of the thickness of a main body, notches, markings applied to a main body (e.g., painted, etched), and any other indicium considered suitable for a particular embodiment. An indicium, or plurality of indicia, can extend along the entirety, or a portion, of the width and/or circumference of a main body. In the illustrated embodiment, each of the first indicium 18 and the second indicium 20 comprises a notch 24 that extends into the main body 12 and along a portion of the width of the main body 12.

A main body 12 of a storage container 10 can be formed of any suitable material and of any suitable number of pieces of material and selection of a suitable material and of a suitable number of pieces of material to form a main body can be based on various considerations, including the structural arrangement of a smokable product intended to be disposed within the storage container. Examples of materials considered suitable to form a main body of a storage container include plastics, polymers, cardboard, naturally occurring materials, such as wood, and any other material considered suitable for a particular embodiment. Examples of numbers of pieces of material considered suitable to form a main body of a storage container include one, at least one, two, a plurality, more than two, and any other number considered suitable for a particular embodiment. In the illustrated embodiment, each of the first piece of material 26 and the second piece of material 28 is formed of cardboard.

Any suitable technique or method of attachment can be used to attach a first piece of material to a second piece of material, or to attach a first portion of material to a second portion of material. Selection of a suitable technique or method of attachment can be based on various considerations, including the type of material that forms a main body of a storage container. Examples of techniques and methods of attachment considered suitable between pieces of material that form a main body of a storage container, or portions of a main body of a storage container, include fusing, welding, using adhesives, using natural gum, and any other technique or method of attachment considered suitable for a particular embodiment.

A storage container can have any suitable dimensions and be formed using any suitable technique or method of manufacture and selection of suitable dimensions and of suitable techniques and methods of manufacture can be based on various considerations, including the structural arrangement of a smokable product intended to be disposed within the storage container. Examples of lengths of storage containers considered suitable include lengths equal to, greater than, less than, or about 79 millimeters, between about 60 millimeters and about 100 millimeters, and any other length considered suitable for a particular embodiment.

Figure 5:
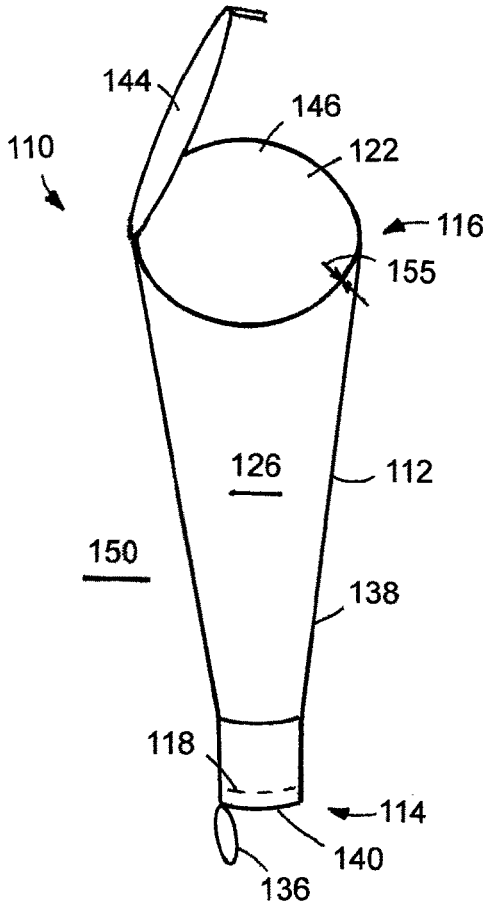
FIG. 5 is a perspective view of the storage container illustrated in FIG. 4. Each of the first end and the second end is in an unsealed configuration.
Figure 6:
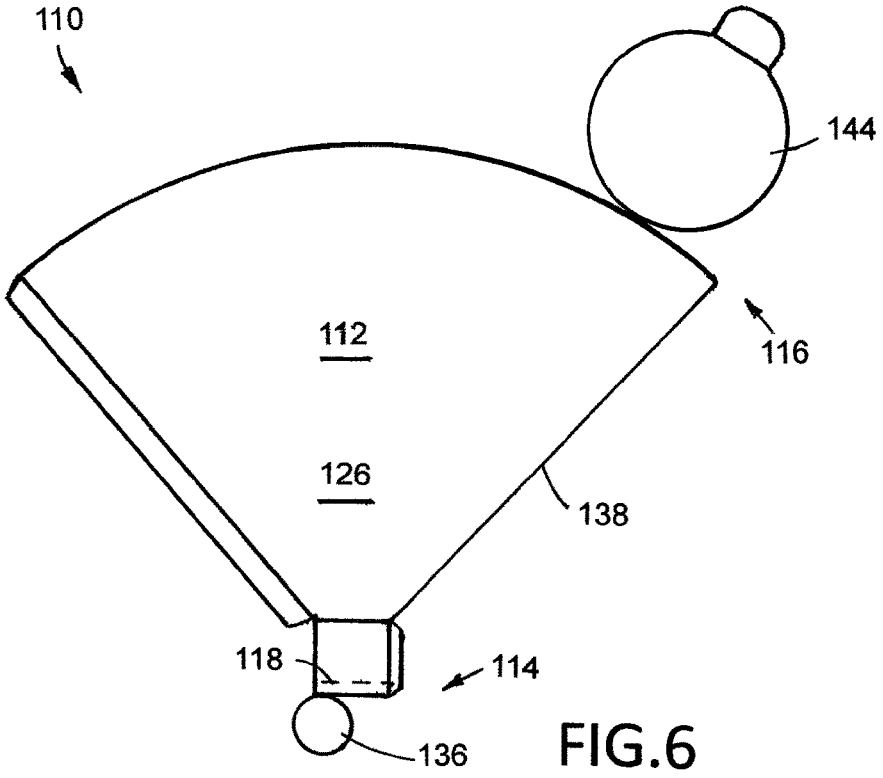
FIG. 6 is a flat plan view of the storage container illustrated in FIG. 4.

FIGS. 1, 5, and 6 illustrate a second example storage container 110. The storage container 110 is similar to the storage container 10 illustrated in FIGS. 1, 2, and 3 and described above, except as detailed below. The storage container 110 has a main body 112 that has a first end 114, a second end 116, a first indicium 118, a lengthwise axis 113, a length 115, a first width 117, a second width 119, a first circumference 151, a second circumference 153, a thickness 155, and defines a chamber 122 and a plurality of perforations 124. In the illustrated embodiment, the main body 112 is formed of a single, continuous piece of material 126.

Figure 4:
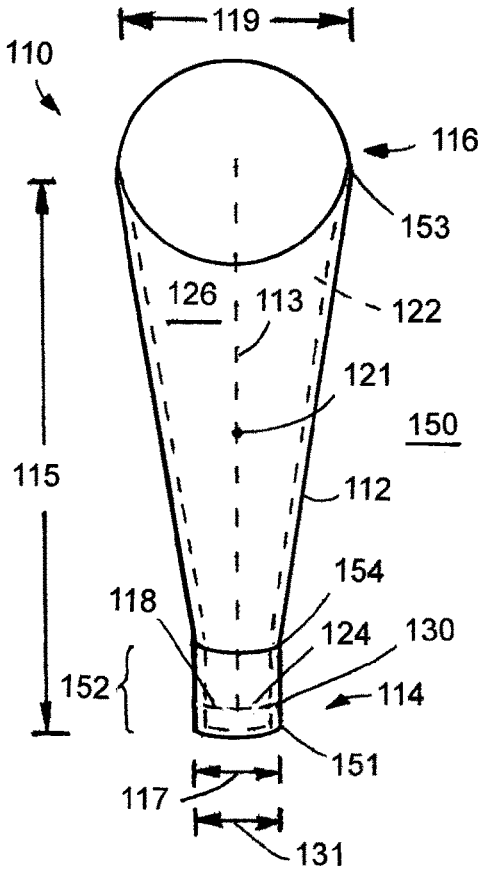
FIG. 4 is a perspective view of a second example storage container. Each of the first end and the second end is in a sealed configuration.

The lengthwise axis 113 extends from the first end 114 to the second end 116 and has a midpoint 121. The length 115 extends from the first end 114 to the second end 116. When assembled, as shown in FIGS. 4 and 5, the first width 117 is disposed at the first end 114, the first circumference 151 is disposed at the first end 114, the second width 119 is disposed at the second end 116, and the second circumference 153 is disposed at the second end 116. The first width 117 is less than the second width 119 and extends along a portion 152 of the length 115 of the main body 112 that extends from the first end 112 to a third location 154 disposed between the first and second ends 114, 116. The width of the main body 112 tapers along a portion of the length 115 of the main body 112 that extends from the second end 116 toward the first end 114 and to the third location 154. In the illustrated embodiment, the second width 119 is greater than 7.5 times the first width 117. The first circumference 151 is less than the second circumference 153 and extends along the portion 152 of the length 115 of the main body 112 that extends from the first end 112 to the third location 154. The circumference of the main body 112 tapers along a portion of the length 115 of the main body 112 that extends from the second end 116 toward the first end 114 and to the third location 154.

In the illustrated embodiment, the first indicium 118 is defined at a first location 130 disposed between the midpoint 121 of the lengthwise axis 113 and the first end 114 and comprises a plurality of perforations 124. The plurality of perforations 124 extends through a portion of the thickness 155 of the main body 112 and along the entire circumference of the main body 112. Alternative embodiments, however, can include a perforation that extends through the entire thickness of a main body and/or along a portion of the circumference of a main body. The first indicium 118 is defined along the portion 152 of the length 115 of the main body 112 that extends from the first end 114 to the third location 154. The main body 112 has a third width 131 at the first location 130 between the midpoint 121 of the lengthwise axis 113 and the first end 114. The third width 131 is equal to the first width 117 and less than the second width 119.

The first end 114 is moveable from a sealed configuration, as shown in FIG. 4, to an unsealed configuration, as shown in FIG. 5. The second end 116 is moveable from a sealed configuration, as shown in FIG. 4, to an unsealed configuration, as shown in FIG. 5. When in the sealed configuration, the main body 112 seals the chamber 122 from an environment exterior 150 to the chamber 122, as shown in FIG. 4. To unseal the storage container 110, a first portion 136 of the storage container 110 is moved relative to a second portion 138 of the storage container 110 to define a first opening 140 that provides access to the chamber 122, as shown in FIG. 5. Alternatively, to move a first portion 136 relative to a second portion 138, a first portion 136 of the storage container 110 is separated from a second portion 138 of the storage container 110 to define a first opening 140 that provides access to the chamber 122 (e.g., tearing the main body 112 at the plurality of perforations 124 defined at the first location 130 and along a portion, or the entirety, of the third width 131). Alternatively, or in combination with moving a first portion 136 relative to a second portion 138, to unseal the storage container 110, a third portion 144 of the storage container 110 is moved relative to the second portion 138 of the storage container 110 to define a second opening 146 that provides access to the chamber 122. When in the unsealed configuration, the chamber 122 is in fluid communication with the environment exterior 150 to the chamber 122, as shown in FIG. 5. The first and third portions 136, 144 can be moved relative to the second portion 138 using any suitable technique or method, such as applying a force on the first and third portions 136, 144 directed away from the second portion 138.

While the first portion 136 and the third portion 144 of the storage container have been illustrated as moveable flaps, a storage container can include any suitable structure to move a storage container between a sealed and unsealed configuration and selection of suitable structure to include on a storage container can be based on various considerations, including the material that forms a storage container. Examples of structures considered suitable to include on a storage container to move it between sealed and unsealed configurations include moveable flaps, interlocking grooves and ridges that form a tight seal when pressed together, moveable flaps that interlock with another portion of a storage container to accomplish movement from an unsealed to a sealed configuration, and any other structure considered suitable for a particular embodiment.

Figure 7:
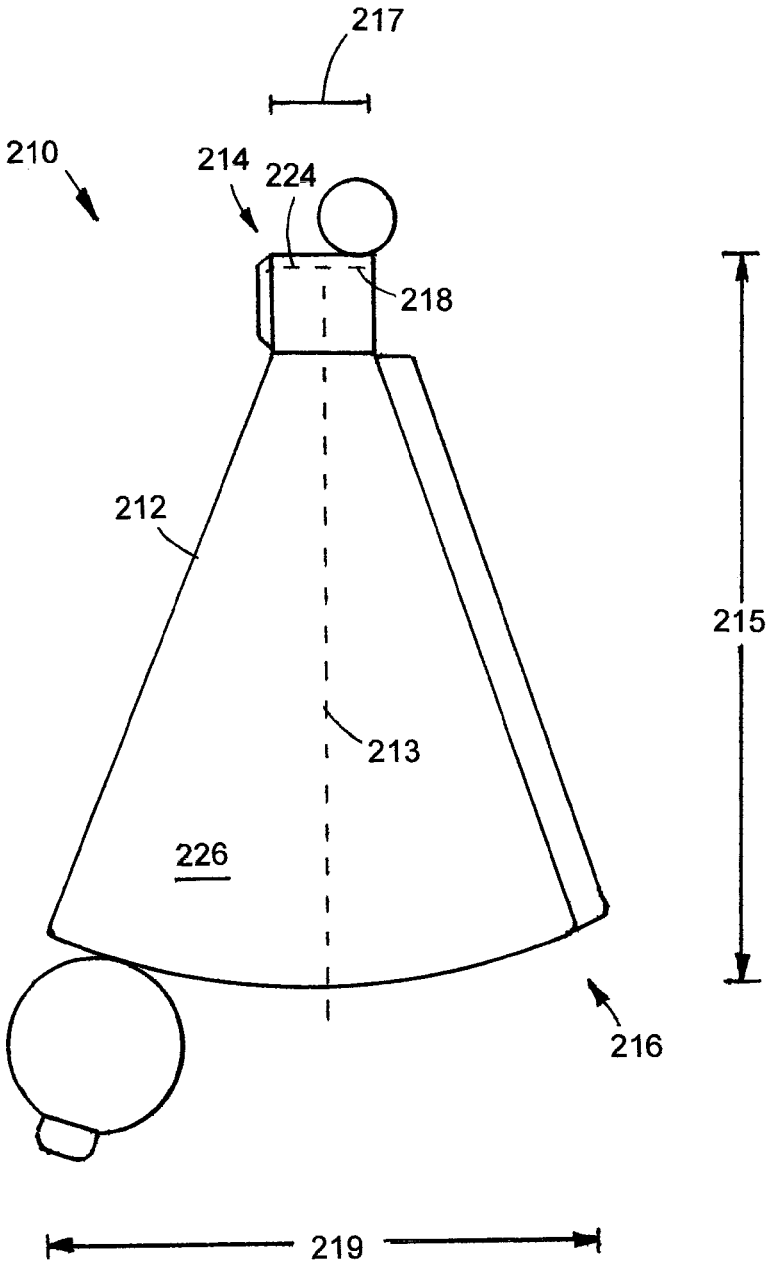
FIG. 7 is a flat plan view of a third example storage container.

FIG. 7 illustrates a third example storage container 210. The storage container 210 is similar to the storage container 110 illustrated in FIGS. 4, 5, and 6 and described above, except as detailed below. The storage container 210 has a main body 212 that has a first end 214, a second end 216, a first indicium 218, a lengthwise axis 213, a length 215, a first width 217, a second width 219, and defines a plurality of markings 224. In the illustrated embodiment, the main body 212 is formed of a single, continuous piece of material 226.

In the illustrated embodiment, the second width 219 is greater than 5 times the first width 217 and the plurality of markings 224 have been applied to the main body 212 using ink. However, alternative embodiments can include a main body that has a second width that is equal to, less than, greater than, or about 5 times a first width, 7.5 times a first width, and any other width considered suitable for a particular embodiment.

Figure 8:
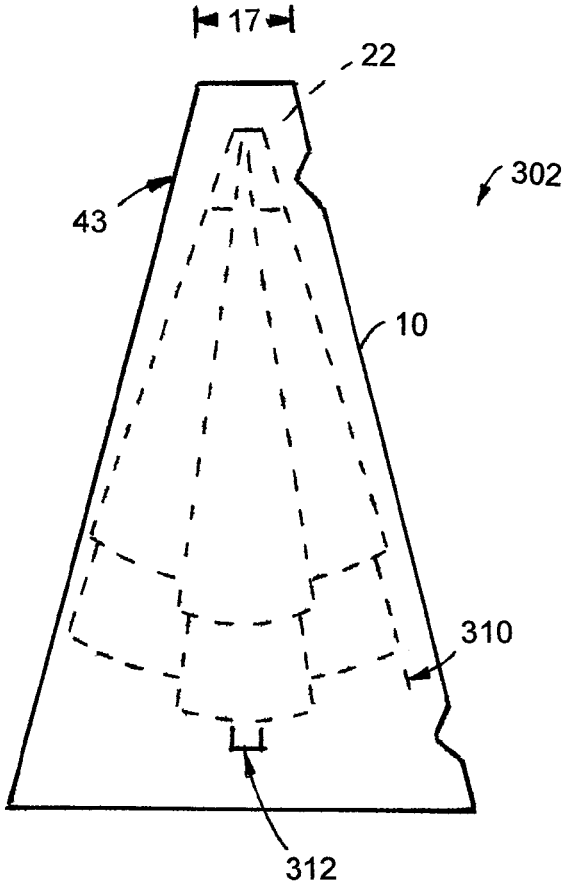
FIG. 8 is an elevation view of a first example product that includes a storage container, a plurality of smokable products, and a packing tool.
Figure 9:
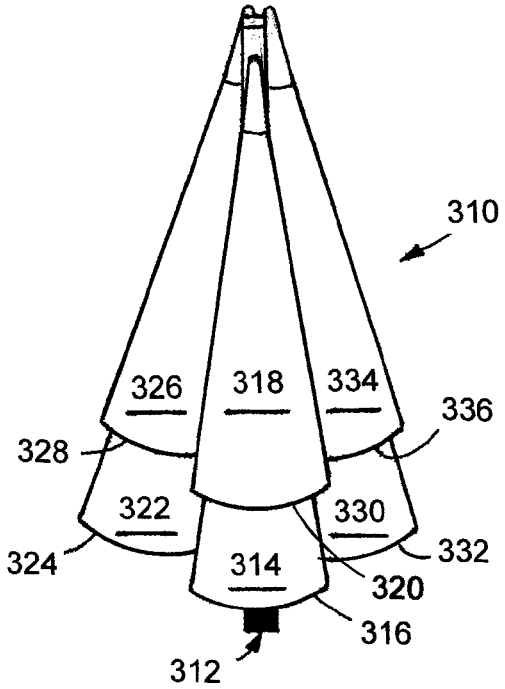
FIG. 9 is a perspective view of the plurality of smokable products and the packing tool illustrated in FIG. 8 free of the storage container.
Figure 10:
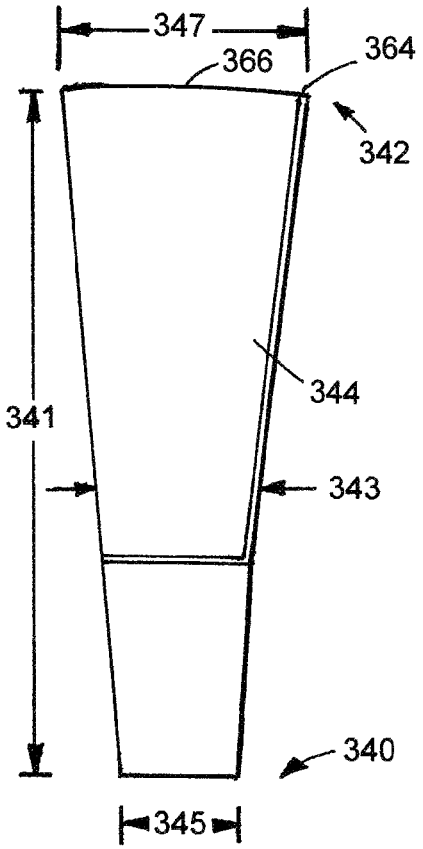
FIG. 10 is an elevation view of a first example smokable product of the plurality of smokable products illustrated in FIG. 8 free of the storage container.
Figure 11:
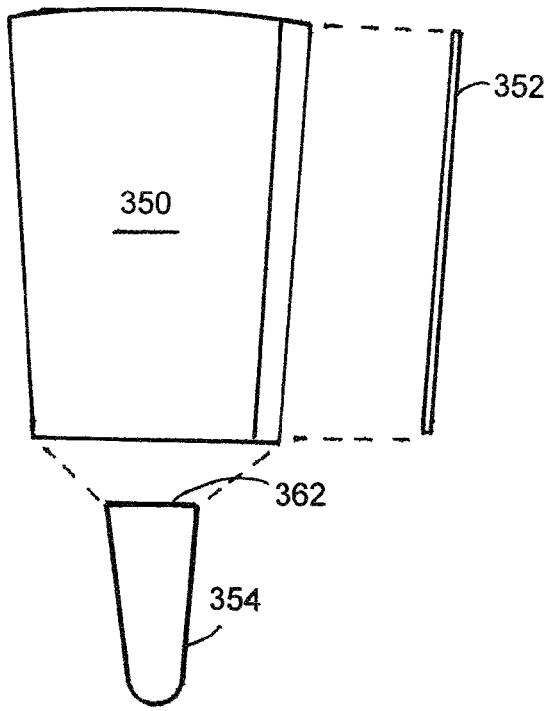
FIG. 11 is an exploded view of the smokable product illustrated in FIG. 10. The sheet of smokable paper is shown in a flat plan view.

FIGS. 8 and 9 illustrate a first example product 302 that includes a storage container 10, as shown in FIGS. 1, 2, and 3, a plurality of smokable products 310, and a packing tool 312.

In the illustrated embodiment, the plurality of smokable products 310 and the packing tool 312 is disposed within the chamber 22 defined by the storage container 10. However, alternative embodiments of a product can include a plurality of smokable products and/or a packing tool disposed within a chamber defined by the storage container 110 illustrated in FIGS. 4, 5, and 6, a chamber defined by the storage container 210 illustrated in FIG. 7, or a chamber of any other suitable storage container. While a packing tool has been illustrated as disposed within the chamber 22 defined by the storage container 10, in alternative embodiments, a packing tool can be omitted from a product. When included, a packing tool can be formed of any suitable material, such as biodegradable materials and organic materials, and have any suitable length (e.g., lengths that are less than a length of a storage container within which it is stored, lengths that are greater than, less than, equal to, or about the length of a smokable product). In the illustrated embodiment, the packing tool 312 has a length that is greater than the length of a smokable product of the plurality of smokable products 310.

As shown in FIGS. 8 and 9, the plurality of smokable products 310 disposed within the chamber 22 comprises a first smokable product 314 defining a first passageway 316, a second smokable product 318 defining a second passageway 320, a third smokable product 322 defining a third passageway 324, a fourth smokable product 326 defining a fourth passageway 328, a fifth smokable product 330 defining a fifth passageway 332, and a sixth smokable product 334 defining a sixth passageway 336. The first smokable product 314 of the plurality of smokable products 310 is partially disposed within the second passageway 320. The third smokable product 322 of the plurality of smokable products 310 is partially disposed within the fourth passageway 328. The fifth smokable product 330 of the plurality of smokable products 310 is partially disposed within the sixth passageway 336. The second smokable product 318 of the plurality of smokable products 310 is disposed adjacent to, and contacts, the fourth smokable product 326 of the plurality of smokable products 310 and the sixth smokable product 334 of the plurality of smokable products 310. The fourth smokable product 326 of the plurality of smokable products 310 is disposed adjacent to, and contacts, the second smokable product 318 of the plurality of smokable products 310 and the sixth smokable product 334 of the plurality of smokable products 310. The sixth smokable product 334 of the plurality of smokable products 310 is disposed adjacent to, and contacts, the second smokable product 318 of the plurality of smokable products 310 and the fourth smokable product 326 of the plurality of smokable products 310.

While six smokable products 314, 318, 322, 326, 330, 334 have been illustrated as being included in the plurality of smokable products 310, a product can include any suitable number of smokable products disposed within a storage container having any suitable structural arrangement. Selection of a suitable number of smokable products to include in a storage container can be based on various considerations, including the material that forms a storage container. Examples of numbers of smokable products considered suitable to include in a storage container include one, more than one, two, a plurality, three, four, five, six, seven, eight, nine, ten, more than ten, and any other number considered suitable for a particular embodiment.

As shown in FIGS. 10, 11, 12, and 13, each smokable product of the plurality of smokable products 310 has a smokable product first end 340, a smokable product second end 342, a smokable product length 341, a smokable product width 343 tapering along the smoking product length 341, and a smokable product main body 344. The smokable product length 341 extends from the smokable product first end 340 to the smokable product second end 342. The smokable product first end 340 has a smokable product first width 345 and the smokable product second end 342 has a smokable product second width 347 that is greater than the smokable product first width 345. In the illustrated embodiment, each of the first width 17 and the fifth width 43 of the storage container 10 is less than the smokable product second width 347 and greater than the smokable product first width 345 such that the storage container 10 can be positioned within a passageway defined by a smokable product, as described in more detail herein. However, alternative embodiments can include a storage container that has a fifth width that is less than a smokable product second width such that the storage container can be positioned within a passageway defined by a storage container.

A smokable product can have any suitable dimensions, such as any suitable second width or circumference, and selection of suitable dimensions for a smokable product can be based on various considerations, including the structural arrangement (e.g., width or circumference of an end of a storage container). Examples of second widths and circumferences considered suitable for a smokable product include widths and circumferences equal to, greater than, less than, or about 0.5 centimeters, 1 centimeter, 1.5 centimeters, 2 centimeters, widths and circumferences between about 0.5 centimeters and about 1.5 centimeters, and any other width and circumference considered suitable for a particular embodiment. Examples of lengths considered suitable for a smokable product include lengths equal to, greater than, less than, or about 79 millimeters, between about 60 millimeters and about 100 millimeters, and any other length considered suitable for a particular embodiment.

Figure 12:
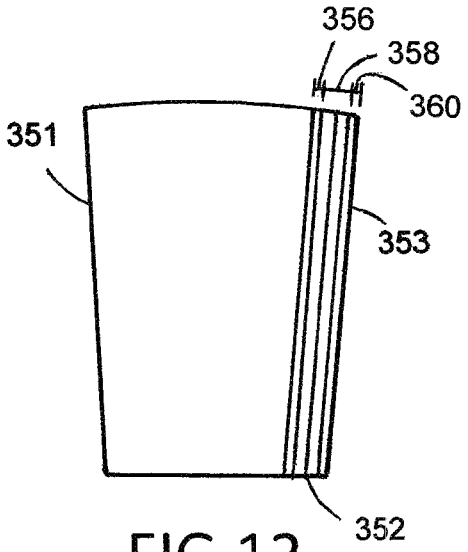
FIG. 12 is an elevation view of the sheet of smokable paper and wire member illustrated in FIG. 11 partially assembled.
Figure 13:
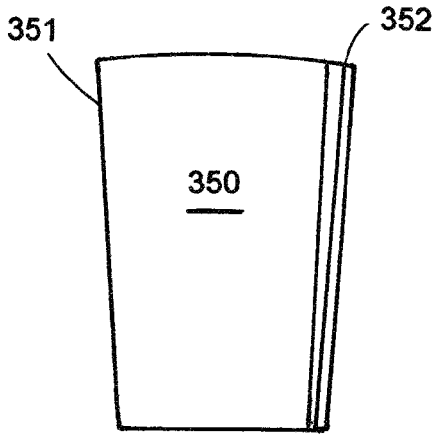
FIG. 13 is an elevation view of the sheet of smokable paper and wire member illustrated in FIG. 11 partially assembled.

Each smokable product of the plurality of smokable products 310 is formed of a smokable sheet of material 350, a wire member 352, and a filter 354. As shown in FIGS. 12 and 13, the smokable sheet of material 350 is formed of a hemp material and has a first side 351, a second side 353, first portion 356, a second portion 358, and a third portion 360. Each of the first and third portions 356, 360 include an adhesive. The second portion 358 is disposed between the first and third portions 356, 360. The wire member 352 is formed of stainless steel and the filter 354 defines a passageway 362 that allows smoke to pass through the filter during use. Alternative embodiments of a smokable product can optionally omit the inclusion of a wire member and/or a filter or include a smokable sheet of material and a wire member formed of any suitable material. Examples of materials considered suitable for a smokable sheet of material include naturally occurring materials, tree-based materials, plant-based materials, rice paper, hemp paper, and any other material considered suitable for a particular embodiment. Examples of materials considered suitable for a wire member include naturally occurring materials, stainless steel, malleable materials, malleable stainless steel materials, and any other material considered suitable for a particular embodiment. Examples of materials considered suitable for a filter include cardboard, naturally occurring materials, non-combustible materials, and any other material considered suitable for a particular embodiment.

To assemble a smokable product, the wire member 352 is positioned on the second portion 358 and the first portion 356 is passed over the wire member 352 and attached to a fourth portion of the smokable sheet of material creating a first passageway 364 within which the wire member 352 is disposed. A fourth portion can be positioned at any suitable location (e.g., between the second portion 358 and the third portion 360, at the second portion 358, at the third portion 360, adjacent the first side 351, between the first side 351 and the second side 353). The third portion 360 is then attached to a fifth portion of the smokable sheet of material (e.g., fifth portion can be the fourth portion, a portion different than the fourth portion, between the second portion 358 and the first portion 356, at the second portion 358, at the first portion 356, adjacent the first side 351, between the first side 351 and the second side 353) creating a second passageway 366 within which the first passageway 364 and wire member 352 are disposed. Alternative embodiments, however, can include a smokable product in which a wire member and a first passageway are disposed outside of a second passageway. Subsequently, the smokable sheet of material 350 is positioned within the passageway 362 defined by the filter 354 and attached to the filter 354.

Figures 13A, 13B, 13C, 13D:
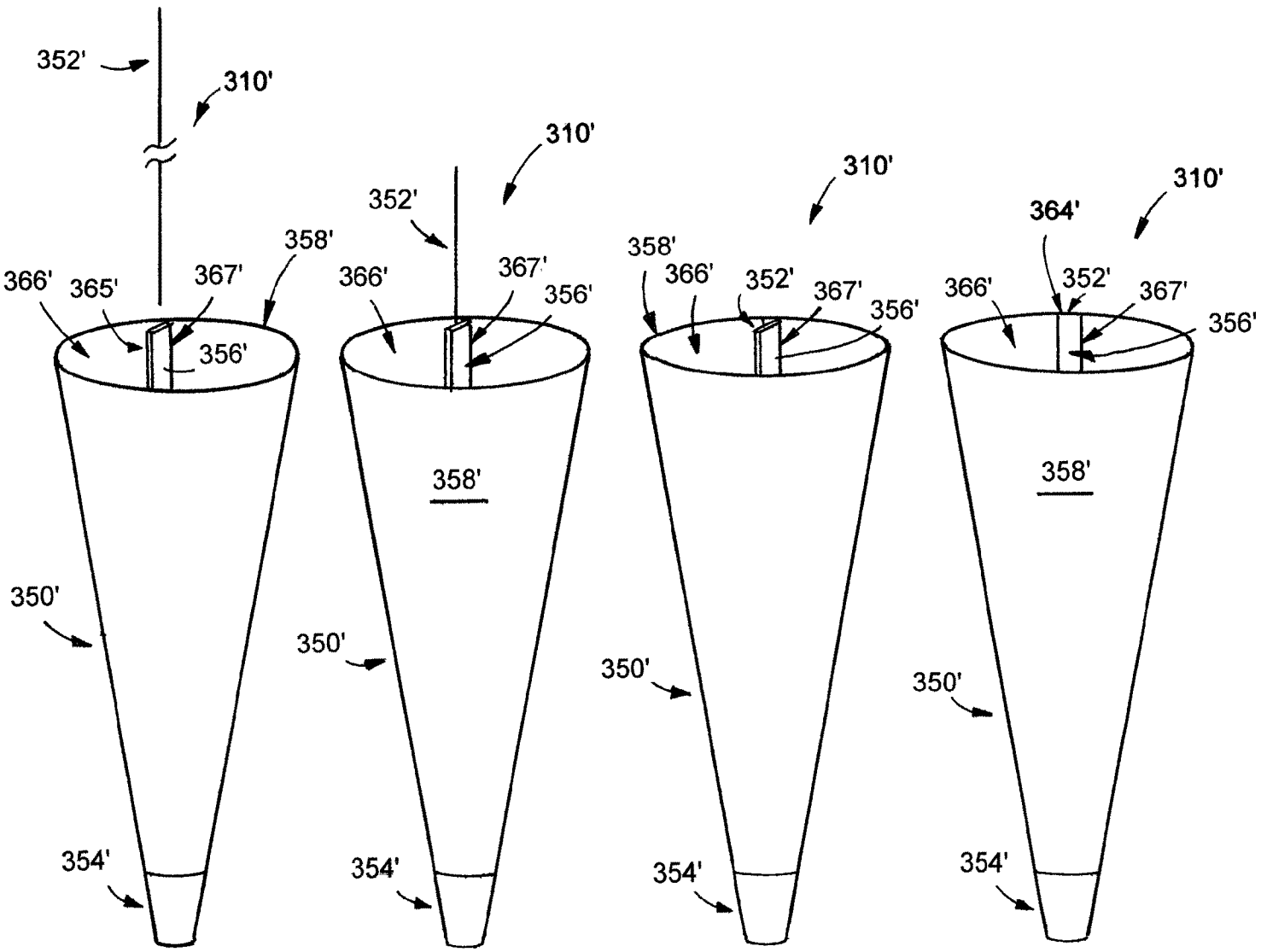
FIG. 13A is a perspective view of another smokable product with the wire member removed from the smokable sheet of material.
FIG. 13B is a perspective view of the smokable product illustrated in FIG. 13A with the wire member partially disposed within a passageway defined by the smokable sheet of material.
FIG. 13C is a perspective view of the smokable product illustrated in FIG. 13A with the wire member entirely disposed within a passageway defined by the smokable sheet of material.
FIG. 13D is a perspective view of the smokable product illustrated in FIG. 13A fully assembled.

Alternatively, a smokable product 310' can be assembled as shown in FIGS. 13A, 13B, 13C, and 13D. The smokable product 310' is formed of a smokable sheet of material 350', a wire member 352', and a filter 354'. As shown in FIG. 13A, the wire member 352' is advanced toward a gap 365' defined between the first portion 356' and the second portion 358' of the smokable sheet of material 350' (e.g., adjacent a paper fold 367' defined by the smokable sheet of material 350'). The second portion 358' is illustrated as forming a second passageway 366' within which smokable material can be disposed. The wire member 352' is advanced until it is entirely disposed between the first and second portions 356', 358' of the smokable sheet of material 350', as shown in FIGS. 13B and 13C. Alternative embodiments, however, can include a wire member that is partially disposed between the first and second portions of a smokable sheet of material. Subsequently, the first portion 356' is attached to the second portion 358' to form a first passageway 364' within which the wire member 352' is disposed. The first portion 356' can be attached to the second portion 358' using any suitable technique or method of attachment, such as those described herein (e.g., adhesive).

The smokable products described herein are considered advantageous at least because they provide structure (e.g., wire member) that assist the user with handling the smokable product during use. For example, while the smokable product is being used, the wire member becomes exposed allowing the user to grasp the wire member instead of, or in combination with, the smokable product to continue use of the smokable product.

While the various storage containers, products, smokable products, packing tools, smokable sheets of material, wire members, and filters have been illustrated as having a particular structural arrangement, a storage container, product, smokable product, packing tool, smokable sheet of material, wire member, and filter can have any suitable structural arrangement and selection of a suitable structural arrangement can be based on various considerations, including the intended use of a smokable product.

Various methods of packing a smoking product are described herein. While the methods described herein are shown and described as a series of acts, it is to be understood and appreciated that the methods are not limited by the order of acts, as some acts may in accordance with these methods, occur in the order shown and/or described, in different orders, and/or concurrently with other acts described herein.

Figure 14:
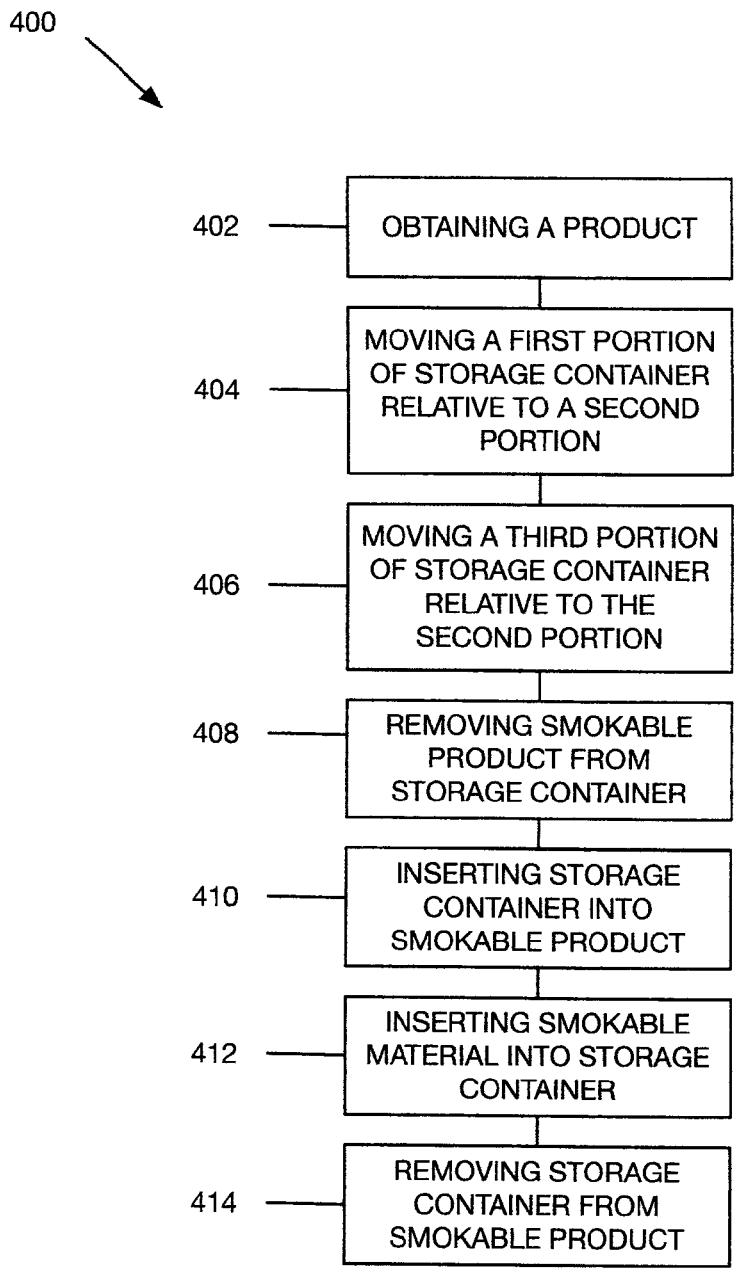
FIG. 14 is a schematic illustration of an example method of packing a smoking product.

FIG. 14 is a schematic illustration of an example method 400 of packing a smoking product.

A step 402 comprises obtaining a product. The product comprises a storage container and a smokable product disposed within the storage container. Another step 404 comprises moving a first portion of the storage container relative to a second portion of the storage container to define a first opening of the storage container that provides access to a chamber defined by the storage container. Another step 406 comprises moving a third portion of the storage container relative to the second portion of the storage container to define a second opening of the storage container that provides access to the chamber defined by the storage container. Another step 408 comprises removing the smokable product from the storage container. Another step 410 comprises inserting an end of the storage container into the second end of the smokable product such that the storage container is partially disposed within the passageway defined by the smokable product. Another step 412 comprises inserting a smokable material through the first opening of the storage container and into the chamber such that the smokable material enters the passageway defined by the smokable product. Another step 414 comprises removing the storage container from the passageway defined by the smokable product.

Step 402 can be accomplished by obtaining any suitable product and selection of a suitable product to obtain can be based on various considerations, including the intended use of the product. Examples of products considered suitable to obtain include product 302, illustrated in FIGS. 8 and 9, a product that includes storage container 10, storage container 110, storage container 210, and/or any other storage container considered suitable for a particular embodiment, a product that includes a smokable product, or plurality of smokable products, such as smokable products 314, and/or any other smokable product considered suitable for a particular embodiment, a product that includes a packing tool, a product that includes smoking material, and/or any other product considered suitable for a particular embodiment.

Step 404 can be accomplished by using any suitable technique or method of moving a first portion of a storage container relative to a second portion of a storage container to define a first opening of the storage container that provides access to a chamber defined by the storage container. Selection of a suitable technique or method to move a first portion of a storage container relative to a second portion of a storage container can be based on various considerations, including the structural arrangement of the storage container. For example, step 404 can be accomplished by applying a first force on a first portion of a main body in a first direction and a second force on a second portion of the main body in a second direction that is different than the first direction, or by maintaining the position of the second portion. Alternatively, this can be accomplished by applying a first force on a second portion of a main body in a first direction and a second force on a first portion of the main body in a second direction that is different than the first direction, or by maintaining the position of the first portion. In embodiments in which storage container 10 is being utilized, this results in tearing the main body 12 at the notch 24 defined at the first location 30 and along a portion, or the entirety, of the third width 31. In embodiments in which storage container 110 is being utilized, this results in the first portion 136 the main body 112 being folded relative to the second portion 138 of the main body 112 or this results in tearing the main body 112 at the plurality of perforations defined at the first location 130 and along a portion, or the entirety, of the third width 131.

Step 406 can be accomplished by using any suitable technique or method of moving a third portion of a storage container relative to the second portion of a storage container to define a second opening of the storage container that provides access to a chamber defined by the storage container. Selection of a suitable technique or method to move a third portion of a storage container relative to the second portion of a storage container can be based on various considerations, including the structural arrangement of the storage container. For example, step 406 can be accomplished by applying a first force on a third portion of the main body in a first direction and a second force on the second portion of the main body in a second direction that is different than the first direction, or by maintaining the position of the second portion. Alternatively, this can be accomplished by applying a first force on the second portion of a main body in a first direction and a second force on a third portion of the main body in a second direction that is different than the first direction, or by maintaining the position of the third portion. In embodiments in which storage container 10 is being utilized, this results in tearing the main body 12 at the notch 24 defined at the second location 32 and along a portion, or the entirety, of the fourth width 33. In embodiments in which storage container 110 is being utilized, this results in the third portion 144 the main body 112 being folded relative to the second portion 138 of the main body 112.

Step 408 can be accomplished by applying a first force on the storage container in a first direction and a second force on the smokable product, or plurality of smokable products, disposed within the chamber defined by the storage container in a second, opposite direction, or by maintaining the position of the smokable product or plurality of smokable products, until the smokable product, or plurality of smokable products are removed from the storage container. Alternatively, step 408 can be accomplished by applying a first force on the smokable product, or plurality of smokable products, disposed within the chamber defined by the storage container in a first direction and applying a second force on the storage container in a second, opposite direction, or by maintaining the position of the storage container, until the smokable product, or plurality of smokable products are removed from the storage container. In embodiments in which a plurality of smokable products have been positioned within a storage container, an optional step that can be completed subsequent to step 408 comprises removing a first smokable product from the plurality of smokable products.

Figure 15:
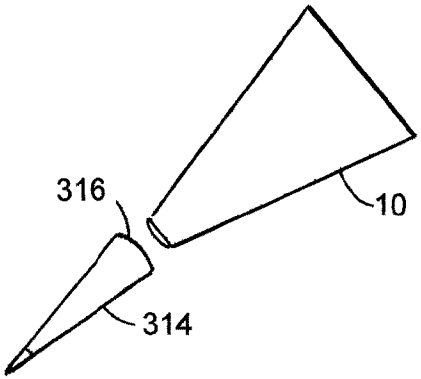
FIG. 15 is a perspective view of a portion of a storage container placed adjacent a smokable product.
Figure 16:
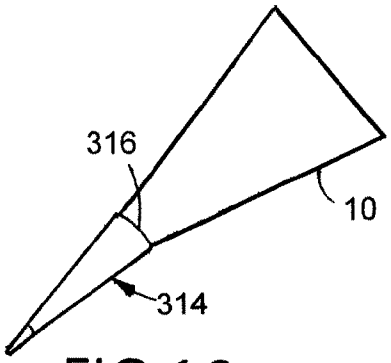
FIG. 16 is another perspective view of the storage container and smokable product illustrated in FIG. 15. The storage container is partially disposed within the smokable product.

Step 410 can be accomplished by applying a first force on the storage container toward the smokable product and a second force on the smokable product toward the storage container until the storage container is disposed within the smokable product. Alternatively, step 410 can be accomplished by applying a first force on the storage container toward the smokable product and maintaining the position of the smokable product until the storage container is disposed within the smokable product. Alternatively, step 410 can be accomplished by applying a first force on the smokable product toward a storage container and maintaining the position of the storage container until the storage container is disposed within the smokable product. FIGS. 15 and 16 illustrate a storage container 10 being inserted into a smokable product 314 such that the storage container 10 is partially disposed within the passageway 316 defined by the smokable product 314.

Step 404, step 406, step 408, and step 410 are considered advantageous at least because they provide a mechanism for inserting the storage container within which the smokable product was previously disposed into the smokable product allowing for the introduction of a smokable material into the smokable product. This approach reduces the tools, materials, and time required to accomplish filling of a smokable product.

Figure 17:
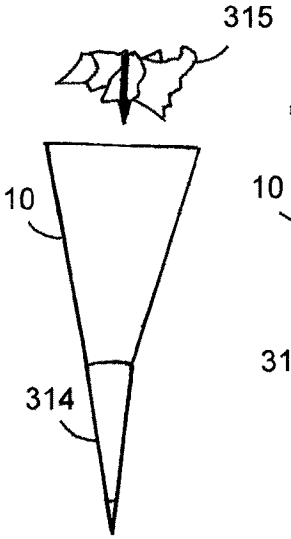
FIG. 17 illustrates a smoking material adjacent the storage container and smokable product illustrated in FIG. 16.
Figure 18:
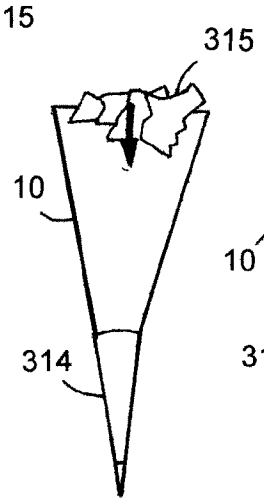
FIG. 18 illustrates a smoking material partially disposed within the storage container illustrated in FIG. 16.
Figure 19:
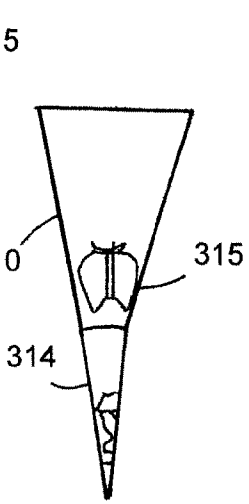
FIG. 19 illustrates the smoking material disposed within the storage container and the smokable product illustrated in FIG. 16.
Figure 20:
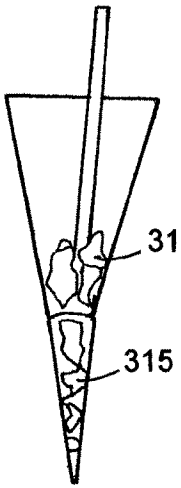
FIG. 20 illustrates the smoking material disposed within the storage container and the smokable product illustrated in FIG. 16 and a packing tool partially disposed within the storage container.

Step 412 can be accomplished using any suitable method or technique of inserting a smokable material through a second opening of a storage container and into a chamber such that the smokable material enters a passageway defined by the smokable product. For example, step 412 can be accomplished by an individual grasping smokable material with his or her hands and inserting it into the storage container. FIGS. 17, 18, and 19 illustrate smokable material 315 being inserted into the storage container 10 and the smokable product 314.

Any suitable smokable material can be inserted into a smokable product and selection of a suitable smokable material can be based on various considerations, including the intended use of the smokable product.

Figure 21:
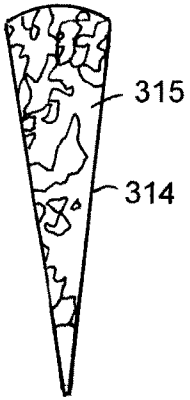
FIG. 21 illustrates the smoking material disposed within the smokable product illustrated in FIG. 16.

Step 414 can be accomplished by applying a first force on the storage container away from the smokable product and a second force on the smokable product away from the storage container until the storage container free of the smokable product. Alternatively, step 414 can be accomplished by applying a first force on the storage container away from the smokable product and maintaining the position of a smokable product until the storage container is free of the smokable product. Alternatively, step 414 can be accomplished by applying a first force on the smokable product away from the storage container and maintaining the position of a storage container until the storage container is free of the smokable product. FIG. 21 illustrates a smokable product 314 free of a storage container.

An optional step that can be completed subsequent to step 412 comprises packing the smokable material into the smokable product. This optional step can be accomplished by inserting a packing tool through the second opening defined by the storage container and into the chamber defined by the storage container such that the packing tool is partially disposed within the chamber. Another optional step comprises advancing the packing tool through the chamber such that the smokable material is advanced into the passageway defined by the smokable product. Another optional step comprises agitating the storage container, packing tool, smokable material, and/or smokable product such that the smoking material advances into the smokable product. Optionally, these optional steps and/or step 412 can be repeated. Another optional step comprises removing the packing tool from the storage container.

Another optional step that can be completed subsequent to step 414 comprises closing the second end of the smokable product to seal the smokable material in the passageway defined by the smokable product.

Those with ordinary skill in the art will appreciate that various modifications and alternatives for the described and illustrated embodiments can be developed in light of the overall teachings of the disclosure, and that the various elements and features of one example described and illustrated herein can be combined with various elements and features of another example without departing from the scope of the invention. Accordingly, the particular examples disclosed herein have been selected by the inventor(s) simply to describe and illustrated examples of the invention and are not intended to limit the scope of the invention or its protection, which is to be given the full breadth of the appended claims and any and all equivalents thereof.

What is claimed is:

1. A smokable product comprising:

a smokable sheet of material having a first end, a second end, a length extending from the first end to the second end, a width, and defining a first passageway, the width tapering along the length; and a straight wire member disposed within the first passageway and removable therefrom after formation.

2. The product of claim 1, wherein the first end has a first width and the second end has a second width that is greater than the first width.

3. The product of claim 1, wherein the width tapers along the entire length.

4. The product of claim 1, wherein the smokable sheet of material defines a second passageway.

5. The product of claim 4, wherein the first passageway is disposed within the second passageway.

6. The product of claim 4, wherein the first passageway is disposed outside of the second passageway.

7. The product of claim 1, wherein the smokable sheet of material is formed of a naturally occurring material.

8. The product of claim 1, wherein the wire member is formed of a naturally occurring material.

9. The product of claim 1, wherein the wire member is formed of stainless steel.

10. The product of claim 1, further comprising a filter defining a filter passageway.

11. The product of claim 10, wherein the smokable sheet of material is partially disposed within the filter passageway.

12. The product of claim 1, further comprising a storage container;

wherein the smokable sheet of material and wire member are disposed within the storage container.

13. A smokable product comprising:

a smokable sheet of material having a first end, a second end, a length extending from the first end to the second end, a width, and defining a first passageway, the width tapering along the length to form a substantially conical smokable product; and a straight wire member disposed longitudinally within the first passageway and removable therefrom after formation.

* * * * *